US005979744A

United States Patent [19]

Brigleb

[11] Patent Number: 5,979,744

[45] Date of Patent: Nov. 9, 1999

[54] OBJECT WRAPPING AND METHOD OF WRAPPING AN OBJECT

[76] Inventor: Mary Beth Brigleb, 121 Academy Ct., Gahanna, Ohio 43230-2101

[21] Appl. No.: 09/047,848

[22] Filed: Mar. 25, 1998

[51] Int. Cl.[6] ..... B65D 65/02

[52] U.S. Cl. ..... 229/87.01; 229/87.19; 383/71; 150/154

[58] Field of Search ..... 383/71, 4, 127; 229/87.01, 87.19; 150/154

[56] References Cited

U.S. PATENT DOCUMENTS

| | | | |
|---|---|---|---|
| 1,204,068 | 11/1916 | Robin et al. | 383/71 X |
| 2,107,692 | 2/1938 | Botelho | 383/71 X |
| 5,004,144 | 4/1991 | Selga . | |
| 5,392,983 | 2/1995 | Clark-Bolling et al. | 229/87.19 |
| 5,456,062 | 10/1995 | Wechsler | 383/71 X |
| 5,515,635 | 5/1996 | Weder et al. | 383/4 X |
| 5,529,395 | 6/1996 | French . | |
| 5,551,570 | 9/1996 | Shaffer et al. | 383/71 X |
| 5,743,458 | 4/1998 | French | 150/154 X |

*Primary Examiner*—Jes F. Pascua
*Attorney, Agent, or Firm*—Kremblas, Foster, Millard & Pollick

[57] ABSTRACT

A decorative gift wrap includes two sheets, each having two ends. One of the sheets is configured to wrap a gift. The first and second ends of the first sheet extend through an aperture in a loop. This frictionally secures the loop adjacent to the sheets.

13 Claims, 6 Drawing Sheets

OBJECT WRAPPING AND METHOD OF WRAPPING AN OBJECT

CROSS-REFERENCES TO RELATED APPLICATIONS

The subject matter of the present application was disclosed in disclosure document number 428,598, filed Dec. 5, 1997 in the U.S. Patent and Trademark Office.

BACKGROUND OF THE INVENTION

1. Field of the Invention

The present invention relates to a gift wrapping and a method of wrapping a gift. More particularly, the present invention involves a gift wrapping with three parts which are reusable.

2. Description of the Related Art

Ever since people began giving gifts, they have desired to cover the gift to hide it until a certain time. Today, the typical consumer purchases a gift, then wraps it in a decorative or at least opaque paper and secures the paper together with adhesive tape. A decorative ribbon or bow may also be attached to the paper. The paper, ribbon, and bow are often destroyed in the process of opening the gift. This results in discarded paper, ribbon, and bow. What is needed is a fabric, or at least partially reusable, gift wrap that has the flexibility to wrap gifts of a variety of sizes.

The patent to Selga, U.S. Pat. No. 5,004,144, discloses a fabric gift wrapping which can be reused. The fabric gift wrapping is secured to itself by a standard fabric fastener, preferably a VELCRO brand hooks-and-loops fastener. However, the Selga reference requires different configurations to wrap different sized packages.

The patent to French, U.S. Pat. No. 5,529,395, discloses a pouch-like wrapping which includes a drawstring. A problem with such a configuration is that it requires an unsightly string which needs to be hidden. The French reference discloses the desirability of flexibility, but the French reference achieves its flexibility in part by using a stretchable material which is expensive and difficult to use with fragile articles.

Neither of these references discloses all the features of the present invention. Neither is able to give as wide a range of flexibility in size or shape of gift as the present invention.

SUMMARY OF THE INVENTION

The present invention is a gift wrapping. The wrapping includes a first sheet and a second sheet, one of the sheets being configured to wrap a gift. Each sheet has a first end and a second end. The first and second ends of the first sheet extend through an aperture in a loop. This frictionally secures the loop adjacent to the sheets.

In one embodiment, the first sheet is a sleeve. The sleeve may have one closed end. In this embodiment, an intermediate portion of the second sheet may extend through the aperture in the loop between the first end and second end of the first sheet.

In a second embodiment, the second sheet is a sleeve. The sleeve may have one closed end. In this embodiment, an intermediate portion of the first sheet extends through the aperture in the loop between the first end and the second end of the second sheet.

One or both of the sheets may be made of fabric. One of the sheets may be made of paper. The loop may be substantially inflexible and may be made of metal. The loop may be circular or rectangular.

The method of wrapping a gift includes providing first and second sheets. Each sheet has first and second ends. One of the sheets is configured to wrap a gift. The gift is placed in that sheet. The first and second ends of a first sheet are passed or extended through an aperture in a loop. This serves to frictionally secure the loop adjacent the sheets. The method may also include passing or extending an intermediate portion of a second sheet through the aperture in the loop. The method may also include passing or extending the intermediate portion of a second sheet through the aperture in the loop between the first end of the first sheet and the second end of the first sheet.

Figure 1:
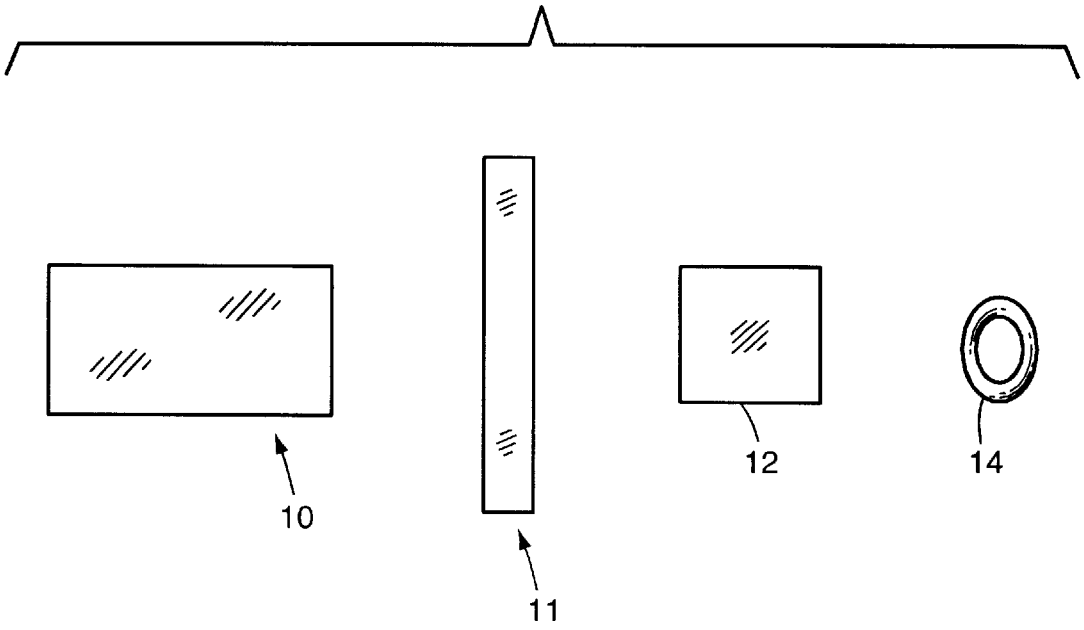
FIG. 1 is a top view showing the pieces of a decorative gift wrapping according to the invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF THE PREFERRED EMBODIMENT

Figure 2:
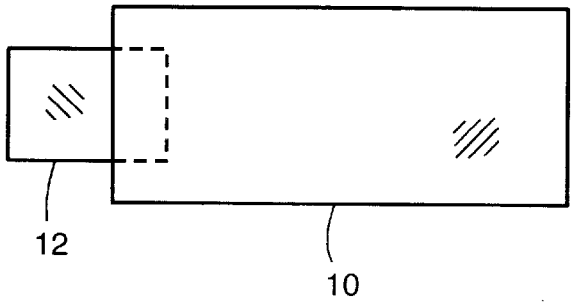
FIG. 2 is a top view illustrating a gift being inserted into a sheet configured to wrap a gift according to the invention.

Turning now to the drawings, FIG. 1 shows the various parts used to make the wrapping according to the invention. The wrapping includes sheets 10,11 and a loop 14. As shown in FIG. 2, one of the sheets 10,11 is configured to wrap and conceal an object, such as a gift 12. Objects that will typically be wrapped include gifts, and also include pillows and other household items that could be wrapped by the invention for decorative purposes. A sheet 10,11 is configured to wrap a gift 12 when it is of an appropriate size and shape to completely cover each surface of the gift 12.

The composition and precise configuration of the sheets 10 may vary. It is preferred that each of the sheets 10 is made of decorative fabric, so that they are attractive, flexible and reusable. However, one or both of the sheets 10 may be made of plain, opaque, tear resistant paper, plastic, or other flexible, reusable material, such as felt or ribbon. In a preferred embodiment, one of the sheets is made of paper, so that a person giving the gift can write on that sheet and use that sheet as a gift tag. The sheet 10, which is configured to wrap a gift, may take a variety of shapes and sizes. The sheet should be sufficiently large that it can cover each of the surfaces of the gift 12 and still accommodate the remaining wrapping procedure to be described below. This sheet, in the preferred embodiment, takes the form of a sleeve or cylinder, so that a gift 12 can be inserted into the sleeve, as shown in FIG. 2. The sleeve or cylinder may be formed from a piece of cloth by sewing two of the opposing edges together, as is preferred. However, the sleeve or cylinder may also be formed by other, standard attachment mechanisms, such as adhesives which are commonly used with fabrics, VELCRO brand hooks-and-loops fastener, or the like. In its most preferred form, the sleeve will have an opening at only one end where the gift 12 may be inserted into the sleeve. The opposite end of the sleeve is closed preferably by the same means used to fasten the opposing edges together initially to form the sleeve.

Figure 12:
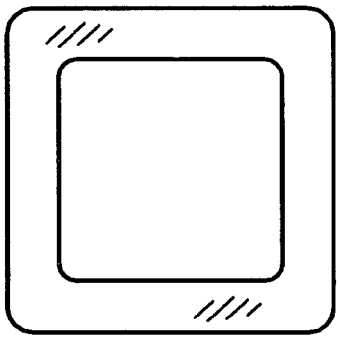
FIG. 12 is a top view illustrating an alternative loop.

One of ordinary skill in the art can also make a variety of modifications to the loop 14 as shown in the Figs. The loop 14 may be, but need not be, circular or oval. Instead it may be square as shown in FIG. 12 or may include a variety of attachments, such as a buckle, a gift tag, or the like. The loop 14 is preferably made of an inflexible material, most preferably metal or rigid plastic, in order to provide the best performance and appearance. However, the invention is not limited by the material or its rigidity. The loop 14 could be made of elastic or string or other flexible material, and could be tied in a loop during the wrapping operation, rather than formed in a loop prior to that operation.

Figure 3:
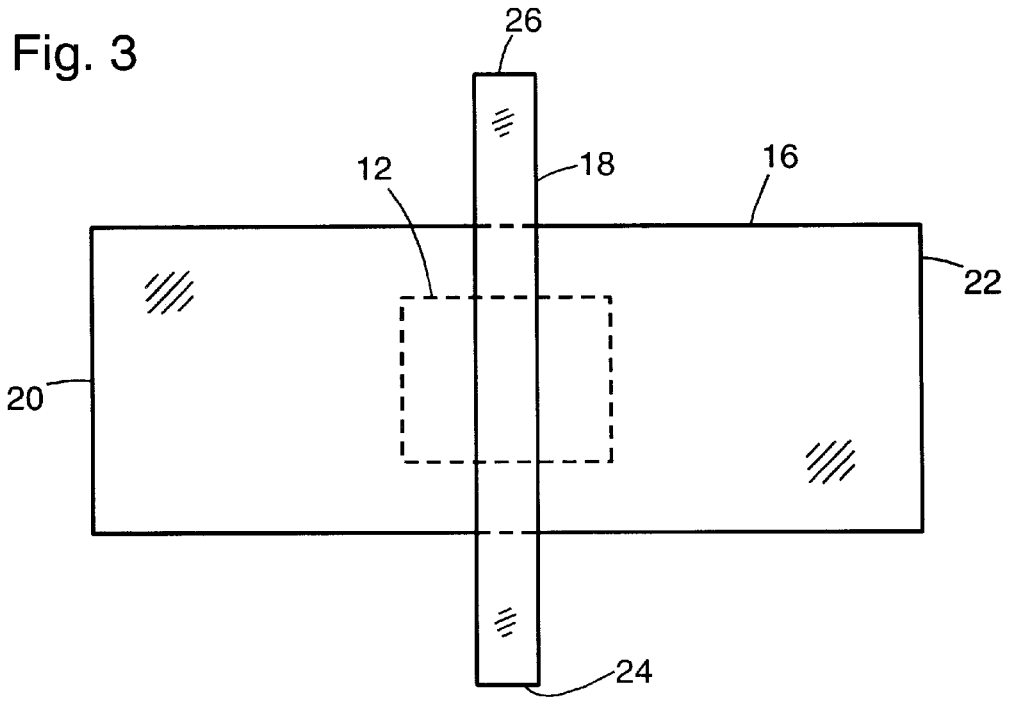
FIG. 3 is a top view illustrating the two sheets placed according to a first embodiment of the invention.

FIGS. 3–7 show a first embodiment of the arrangement of the sheets and loop according to the invention. As shown in FIG. 3, the first sheet 16 has a first end 20 and a second end 22. The second sheet 18 has a first end 24 and a second end 26. In this embodiment, the first sheet 16 is configured to wrap a gift 12 and is preferably a sleeve. The first sheet 16 may have an end which is closed.

Figure 4:
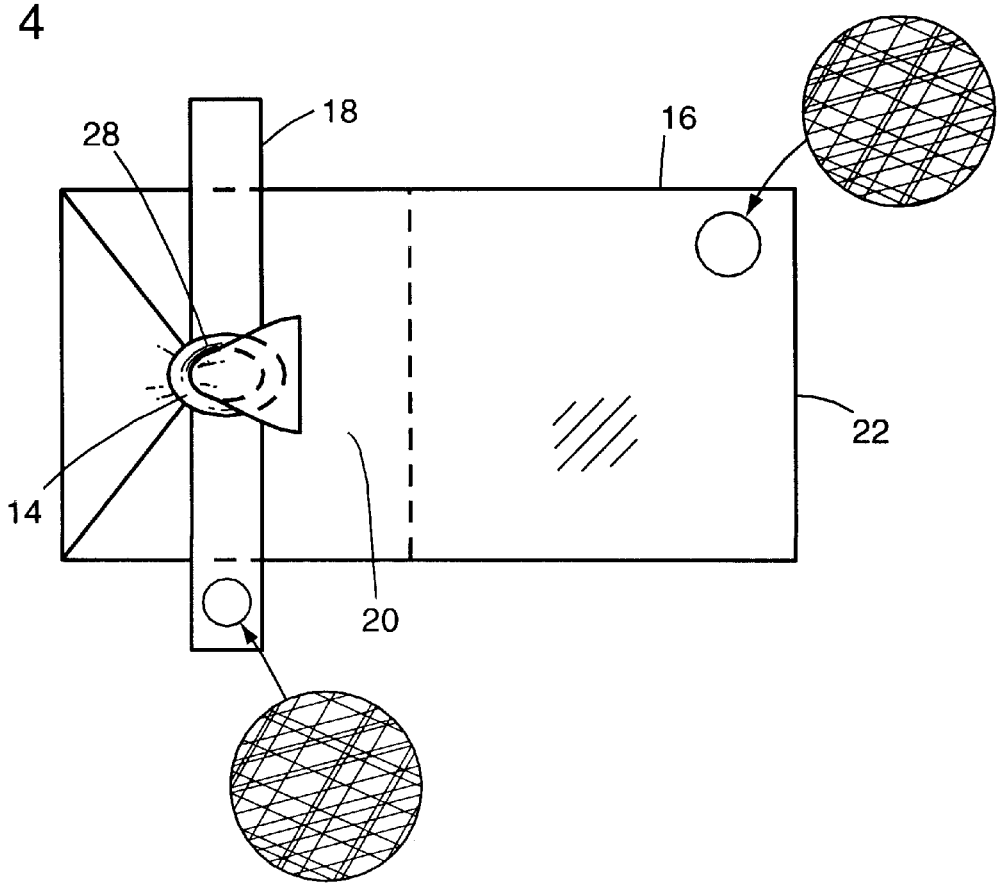
FIG. 4 is a top view illustrating the two sheets and the loop placed according to a first embodiment of the invention, one end of a first sheet having been passed through an aperture in the loop.
Figure 5:
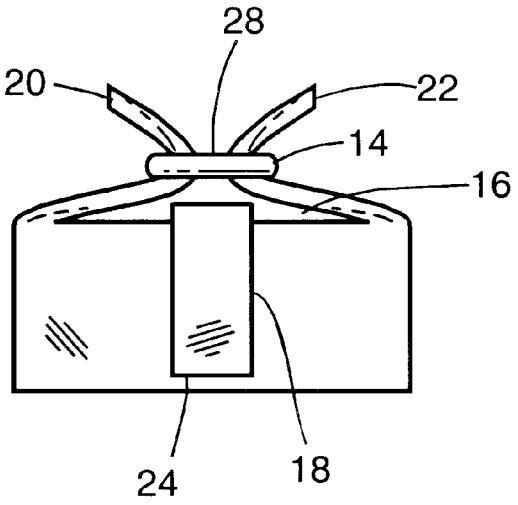
FIG. 5 is an end view illustrating the two sheets adjacent the loop according to a first embodiment of the invention, both ends of the first sheet having been passed through the aperture in the loop.
Figure 6:
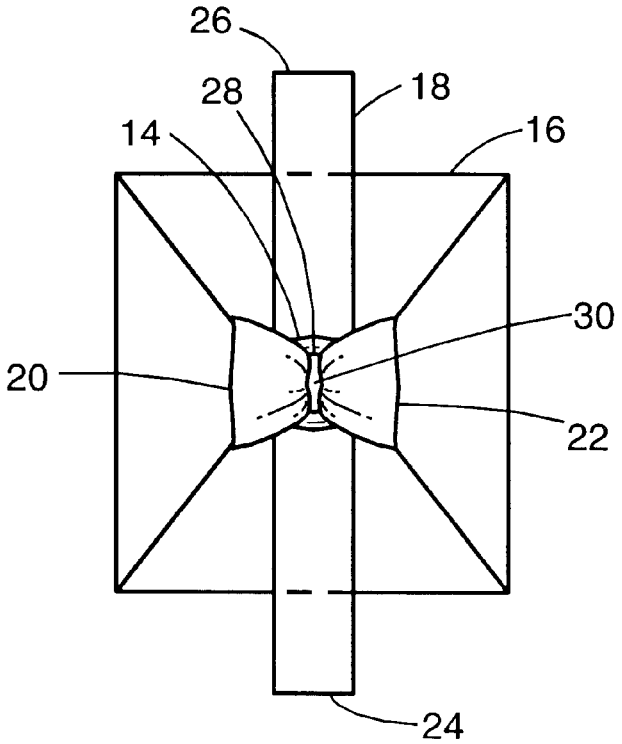
FIG. 6 is a top view illustrating the first embodiment of the invention as shown in FIG. 5.

Turning to FIG. 4, the first end 20 of the first sheet 16 is passed or positioned to extend through the aperture 28 in the loop 14. The second end 22 of the first sheet 16 is also passed or positioned to extend through the aperture 28 in the loop 14, to be positioned as is shown in FIGS. 5 and 6. Once the first and second ends 20, 22 of the first sheet 16 are passed or positioned to extend through the aperture 28 in the loop 14, the loop 14 is pushed to be adjacent to each of the first sheet 16 and the second sheet 18, as best seen in FIG. 5, the loop 14 being in close proximity to each of sheet 16 and sheet 18, but not necessarily touching or seating against each. The loop 14 is thus secured in place through a frictional engagement between the loop 14 and the first sheet 16, most particularly between the loop 14 and the ends 20,22 of the first sheet 16.

Figure 7:
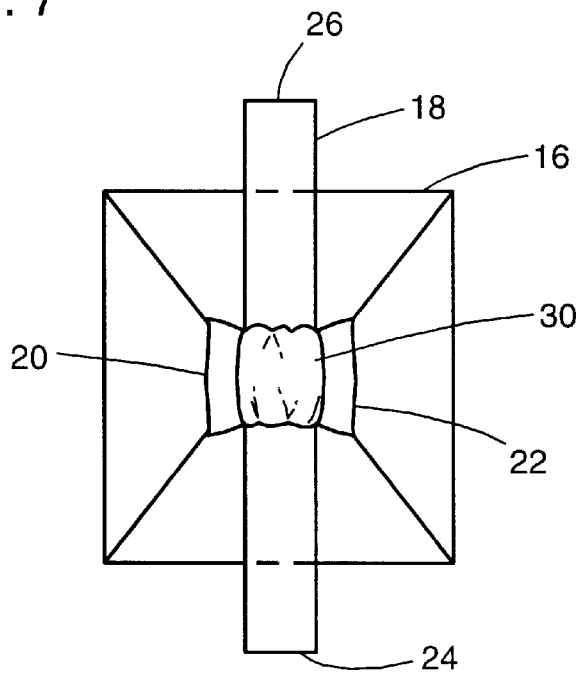
FIG. 7 is a top view illustrating the first embodiment of the invention, an intermediate portion of the second sheet having been passed through the aperture in the loop.

As shown in FIGS. 6 and 7, the second sheet 18 includes an intermediate portion 30. The intermediate portion 30 may be passed or positioned to extend through the aperture 28 in the loop 14, such as with a fingertip pushing from beneath the second sheet 18 and up through the aperture 28. The preferred location for the intermediate portion 30 to extend through the aperture 28 in the loop 14 is between the first end 20 and the second end 22 of the first sheet 16. The intermediate portion of the second sheet 18 provides additional frictional engagement between the sheets 16,18 and the loop 14 to retain the structure in the position shown in FIGS. 5, 6, and 7.

Figure 8:
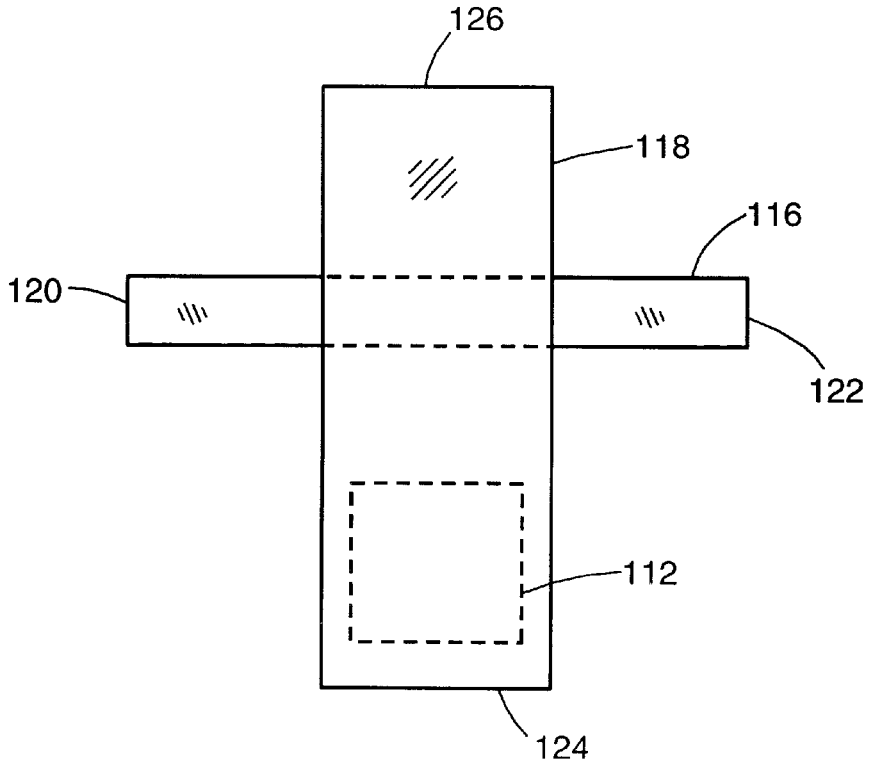
FIG. 8 is a side view illustrating the two sheets and gift according to the second embodiment of the invention.

A second embodiment of the arrangement of the first and second sheets and loop is shown in FIGS. 8–11. As shown in FIG. 8, the first sheet 116 has a first end 120 and a second end 122. The second sheet 118 has a first end 124 and a second end 126. In this embodiment, the second sheet 118 is configured to wrap a gift 112 and is preferably a sleeve. One of the ends of the second sheet 118 may be closed.

Figure 9:
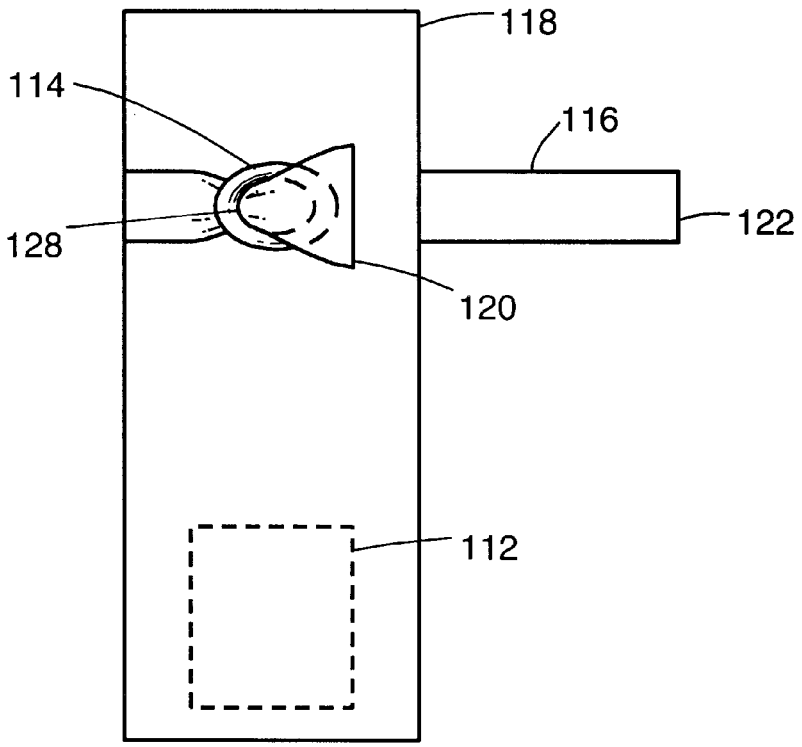
FIG. 9 is a side view illustrating the two sheets and loop placed according to a second embodiment of the invention, one end of a first sheet having been passed through an aperture in the loop.
Figure 10:
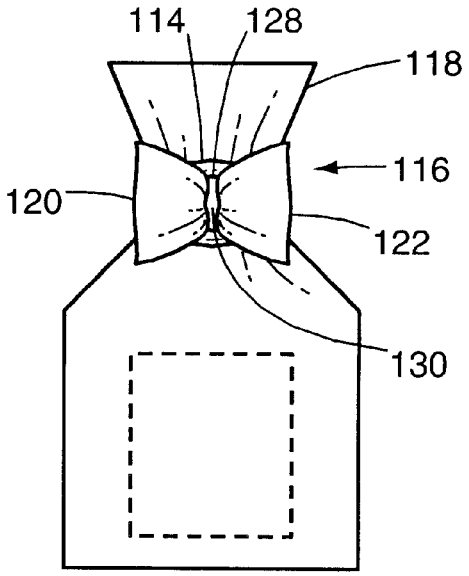
FIG. 10 is a side view illustrating the two sheets adjacent the loop according to a second embodiment of the invention, both ends of the first sheet having been passed through the aperture in the loop.

Turning to FIG. 9, the first end 120 of the first sheet 116 is passed or positioned to extend through the aperture 128 in the loop 114. The second end 122 of the first sheet 120 is also passed or positioned to extend through the aperture 128 in the loop 114, to be positioned as is shown in FIG. 10. Once the first and second ends 120, 122 of the first sheet 116 are passed or positioned to extend through the aperture 128 in the loop 114, the loop 114 is pushed to be adjacent to each of the first sheet 116 and the second sheet 118, similar to the configuration shown in FIG. 5. The loop 114 is thus secured in place through a frictional engagement between the loop 114 and the first sheet 116, most particularly between the loop 114 and the parts of the sheet 116 near the ends 120,122.

Figure 11:
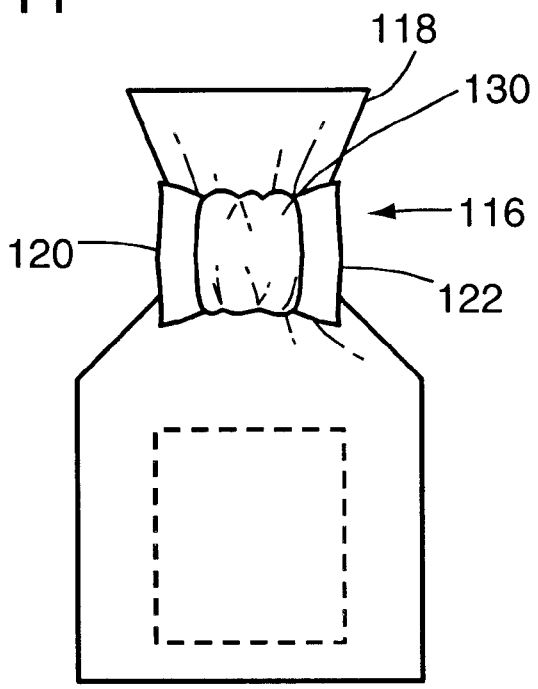
FIG. 11 is a side view illustrating the second embodiment of the invention, an intermediate portion of the second sheet having been passed through the aperture in the loop.

As shown in FIGS. 10 and 11, the second sheet 118 includes an intermediate portion 130. The intermediate portion 130 may be passed or positioned to extend through the aperture 128 in the loop 114, such as by pushing it through with a finger. The preferred location for the intermediate portion 130 to extend through the aperture 128 in the loop 114 is between the first end 120 and the second end 122 of the first sheet 116.

The selection of which embodiment to use to wrap any particular gift 12 depends on a variety of factors, including the size and shape of the gift 12. If the gift 12 is square, as is illustrated in most of the Figs., it is likely that the most aesthetically pleasing arrangement of the sheets 10 and the loop 14 is that shown in the first embodiment. If, on the other hand, the gift 12 is long and slender, such as a bottle, it is likely that the most aesthetically pleasing arrangement of the sheets and loop is that shown in the second embodiment. However, any gift may be wrapped with either technique. The size and/or the shape of the first and second sheets may vary, however, with the size of the gift. One of ordinary skill in the art is able to adjust the size or shape of the first and second sheets for any size or shape of gift 12, such as by selecting a sheet of a larger size if the gift 12 is not fully covered by the sheet.

While certain preferred embodiments of the present invention have been disclosed in detail, it is to be understood that various modifications may be adopted without departing from the spirit of the invention or scope of the following claims.

I claim:

1. A wrapping, comprising:

(a) first and second sheets, each sheet having first and second ends, wherein the first sheet wraps and at least partially conceals an object, and an outer surface of the second sheet seats against an outer surface of the first sheet; and (b) a loop having an aperture defined by a loop inner surface, said first and second ends of the first sheet extending through the aperture and frictionally engaging the loop inner surface for securing said loop adjacent said sheets;

wherein the first sheet is a sleeve, and an intermediate portion of the second sheet extends through the aperture in the loop between the first end of the first sheet and the second end of the first sheet.

2. The wrapping according to claim 1, wherein one end of said sleeve is closed.

3. The wrapping according to claim 1, wherein at least one of said sheets is made of fabric.

4. The wrapping according to claim 3, wherein each of said sheets is made of fabric.

5. The wrapping according to claim 3, wherein the other of said sheets is made of paper.

6. The wrapping according to claim 1, wherein at least one of said sheets is made of paper.

7. The wrapping according to claim 1, wherein said loop is substantially inflexible.

8. The wrapping according to claim 7, wherein said loop is metal.

9. The wrapping according to claim 7, wherein said loop is plastic.

10. The wrapping according to claim 1, wherein said loop is circular.

11. The wrapping according to claim 1, wherein said loop is rectangular.

12. A wrapping, comprising:

(a) first and second sheets, each sheet having first and second ends, wherein the first sheet wraps and at least partially conceals an object, and an outer surface of the second sheet seats against an outer surface of the first sheet; and (b) a loop having an aperture defined by a loop inner surface, the first and second ends of the second sheet extending through the aperture and frictionally engaging the loop inner surface for securing the loop adjacent the sheets;

wherein the first sheet is a sleeve, and an intermediate portion of the first sheet extends through the aperture in the loop between the first end of the second sheet and the second end of the second sheet.

13. A method of wrapping an object, comprising:

(a) providing first and second sheets, each sheet having first and second ends;

(b) placing the object within one of said sheets;

(c) passing said first end and said second end of said first sheet through an aperture in a loop, thereby frictionally securing said loop adjacent said sheets; and (d) passing an intermediate portion of a second sheet through said aperture in said loop between said first end of said first sheet and said second end of said first sheet.

* * * * *